US009261327B1

(12) United States Patent
Lyman

(10) Patent No.: US 9,261,327 B1
(45) Date of Patent: Feb. 16, 2016

(54) REMOVABLE HAMMER SHROUD

(71) Applicant: Robert Neale Lyman, Centennial, CO (US)

(72) Inventor: Robert Neale Lyman, Centennial, CO (US)

( * ) Notice: Subject to any disclaimer, the term of this patent is extended or adjusted under 35 U.S.C. 154(b) by 28 days.

(21) Appl. No.: 14/322,074

(22) Filed: Jul. 2, 2014

Related U.S. Application Data

(60) Provisional application No. 61/842,193, filed on Jul. 2, 2013.

(51) Int. Cl.

| | |
|---|---|
| ***F41A 35/04*** | (2006.01) |
| ***F41C 27/00*** | (2006.01) |
| ***F16B 2/22*** | (2006.01) |
| ***F16B 2/24*** | (2006.01) |

(52) U.S. Cl.
CPC . *F41C 27/00* (2013.01); *F16B 2/22* (2013.01); *F16B 2/24* (2013.01)

(58) Field of Classification Search
USPC ..... 42/96, 66
See application file for complete search history.

(56) References Cited

U.S. PATENT DOCUMENTS

| | | | | |
|---|---|---|---|---|
| 2,579,736 | A * | 12/1951 | Gartner | F41A 19/17 42/66 |
| 2,647,338 | A * | 8/1953 | McNally | F41A 17/74 42/66 |
| 4,914,846 | A * | 4/1990 | Shivers | F41A 17/74 42/65 |
| 2008/0274632 | A1 * | 11/2008 | Lenfert | H01R 4/2404 439/125 |

* cited by examiner

*Primary Examiner* — J. Woodrow Eldred
(74) *Attorney, Agent, or Firm* — Robert N Lyman

(57) ABSTRACT

A shroud for covering the hammer of a firearm, requiring no alteration to the firearm, that may be easily removed or fall off when the firearm is used.

8 Claims, 2 Drawing Sheets

REMOVABLE HAMMER SHROUD

BACKGROUND

Compact double-action revolvers are popular choices for self-defense purposes, both for citizen concealed carry and as backup guns for law enforcement. However, the historic revolver design with an exposed hammer with a spur for cocking can be problematic because it has what amounts to a large metal hook that can catch on clothing while the gun is being drawn. Since guns are drawn, almost by definition, in life-threatening circumstances, any delay in the presentation of the weapon could have fatal consequences. In the past, this problem has been solved in 3 ways. "Hammerless" revolvers have the hammer completely enclosed by the frame. "Shrouded" revolvers have a shroud that covers both sides of the hammer, but leaves a small part of the hammer spur available for thumb-cocking. Finally, the hammer spur may be completely removed or "bobbed." Hammerless and bobbed revolvers may only be fired double-action, which limits accuracy, while shrouded revolvers may be fired single action, but the remaining exposed portion of the spur is still vulnerable to snagging. Furthermore, the shrouds are often considered aesthetically unappealing.

In addition, modification of a revolver from a conventional to a bobbed or shrouded style may require permanent alterations to the gun, preferably performed by a gunsmith. This is costly and can hurt resale value.

SUMMARY

A removable shroud that attaches to the hammer spur of a firearm.

DESCRIPTION

Figure 1:
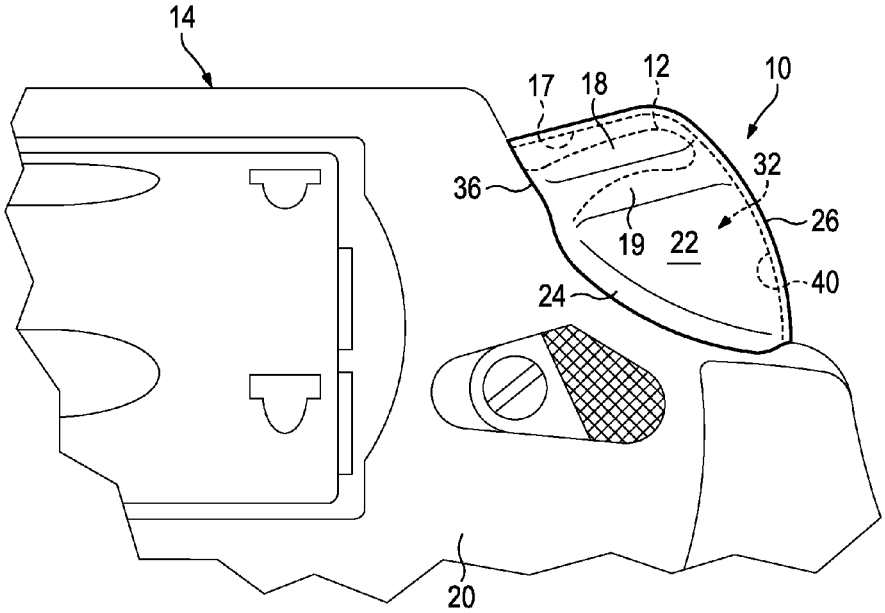
FIG. 1 shows one embodiment of a removable hammer shroud mounted on a revolver with the hammer in the uncocked position.

FIG. 1 depicts one embodiment of a removable hammer shroud 10 mounted on revolver 14 in order to temporarily shield the spur 12 of a revolver's 14 hammer. The shroud has a clip portion 18 which attaches to the hammer, preferably at the spur 12. This clip portion 18 should grip the spur 12 tightly enough to remain in place during holstered carry. In one embodiment, the clip portion comprises a top 17 and a narrow section 19. The spur 12 fits between the top 17 and the narrow section 19, and the narrow section 19 has a width in use that is slightly smaller than that of the spur 12, pinching the spur 12 and pushing it upward into contact with the top 17. Since the spur 12 is conventionally checkered to make it non-slip, it will tend to "bite" the top 17 and prevent the shroud 10 from sliding backwards. If the shroud 10 is displaced slightly, the elastic nature of the material will tend to push it back into position. In this way the spur 12 is gripped securely and small forces cannot remove it.

Figure 4:
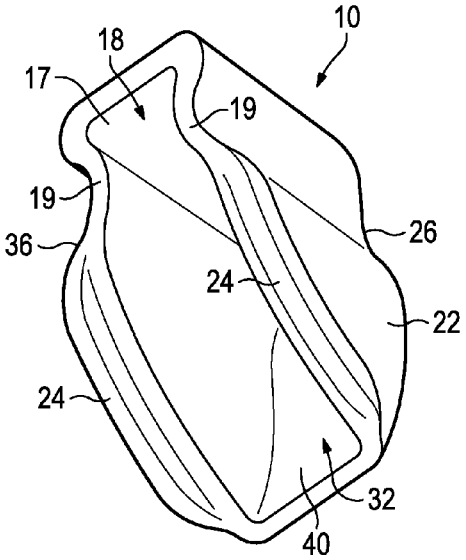
FIG. 4 is a perspective drawing of one embodiment of a removable hammer shroud showing the front and interior of the shroud.

For further security in retaining the shroud 10, it should also contact frame 20 of the revolver 14. In a preferred embodiment, the frame contacting portion 24 is designed to match the contours of the revolver 14 and drape slightly over the sides, as best shown in FIG. 4. This helps the shroud 10 to resist sideward forces that might otherwise dislodge it from the revolver 14. However, it poses no hindrance to backward movement of the shroud 10, which is important in use as discussed below. The body 22 of the shroud 10 connects the frame contacting portion 24 to the clip portion 18 and provides a smooth surface along the back 26 of the shroud that guides clothing over the spur 12, preventing snags.

In order to grip the spur 12, the clip portion 18 must have some elasticity. Preferably, the shroud 10 is formed of a single piece of flexible material. Examples include such polymers as nylon, ABS, or alloyed polymers. Particularly preferred is an alloy of acrylic and PVC, such as Kydex®. Metal may also be used, but has a greater tendency to mar surfaces that it contacts. The dimensions of the shroud 10 must be adapted to the particular revolver 14 to which it is attached.

Because the purpose of carrying a concealed handgun and drawing it quickly is self-defense, the shroud 10 must not interfere with the operation of the gun. It must therefore be designed to release its grip on the spur 12 easily when the spur 12 moves backward under pressure from the trigger. For this reason, the clip portion 18 must not grip so tightly that it locks the spur 12 in position. The elasticity of the material and the width of the narrow portion 19 must be chosen so as to balance the need to keep the shroud 10 in place with the need to allow movement of the hammer. Through experiment, it has been determined that Kydex® or ABS approximately 1/16" thick, when vacuum thermoformed over a die having a narrow portion 0.005"-0.010" inches narrower than the widest point of the spur, provides this balance. In addition, the shroud 10 is preferably hollow, and void 32 provides space for the spur 12 to move freely.

Figure 2:
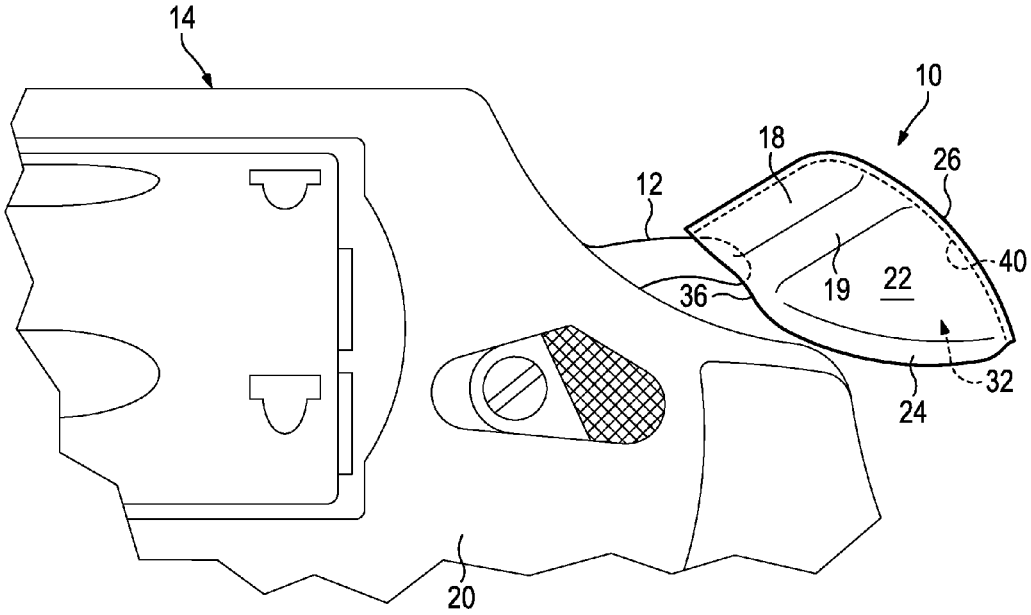
FIG. 2 shows one embodiment of a removable hammer shroud falling free from the hammer as the revolver is fired by a user with a relatively low grip on the revolver.

When the hammer moves back, the shroud 10 may fall free in two different ways. When a user has a relatively low grip on the revolver as shown in FIG. 2, the shroud 10 initially moves directly backwards with the spur 12. This pushes the frame contacting portion 24 of the shroud 10 off of the revolver. As the hammer tilts further downward, the front 36 of the shroud 10 contacts the revolver and prevents the shroud 10 from rotating with the spur 12. This action twists the clip 18 off of the spur 12 and permits the shroud to come loose.

Figure 3:
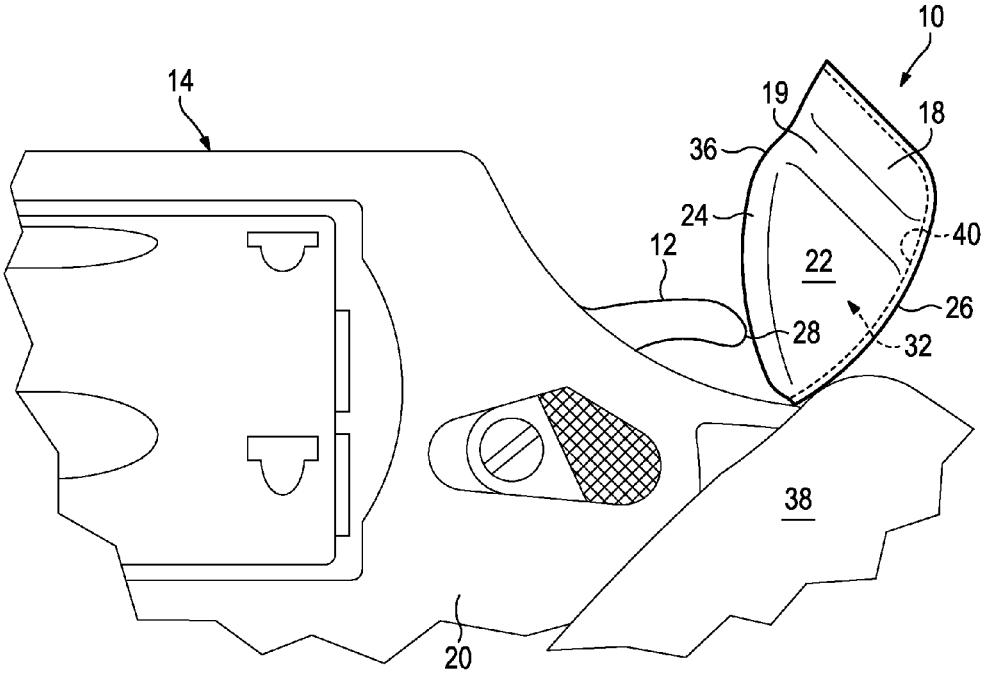
FIG. 3 shows one embodiment of a removable hammer shroud falling free from the hammer as the revolver is fired by a user with a relatively high grip on the revolver.

When a user has a high grip on the revolver, as shown in FIG. 3, the shroud 10 cannot move straight back because of the interference of the user's hand 38. Instead it pivots backward. This results in a relatively rapid release by the clip 18 from the spur 12. However, it poses a problem for proper operation of the revolver, because shroud 10 may become trapped between the tip 28 of the spur 12 and the user's hand 38. For this reason, a relatively large void 32 and a relatively thin back wall 40, as best shown in FIG. 4, are both important. Experimentation has shown that for a polymer shroud 10, a back wall 40 thickness of about 0.080" or less is sufficiently thin to permit operation of the revolver even with a high grip, while sufficient overall strength is available down to as thin as 0.060". After the first shot, the shroud 10 typically falls away and no longer is a factor.

Production of shroud 10 may be accomplished in a number of ways. A polymer shroud may be injection molded. A metal shroud could be formed on a die. The simplest method of forming a useful shroud is thermoforming, in which a sheet of thermoplastic is heated until it is pliable, and then draped over a die corresponding to the desired final shape of the interior of the shroud 10, and then pushed downward. A variety of means of pressing the material downward are known, including hydraulic pressure and foam rubber. The simplest is the application of a vacuum underneath the shroud, so that ambient air pressure forms the plastic to the die. This is known as vacuum thermoforming and is widely used in the plastics industry.

It should be noted that while spurred hammers are most common on revolvers, there are also other guns which may benefit from the snag-preventing properties of the shroud. Some semi-automatic handguns are designed to permit a double-action first shot followed by single-action shots as the recoiling slide cocks the hammer each time. These may also benefit from a shroud 10 to reduce snags. Also, various rifles and shotguns, including lever and pump-action models, have exposed hammers that can catch on clothing, scabbards, or cases, causing difficulty bringing the gun into service and damage to whatever it snags on. These too may benefit from a removable shroud 10. Therefore, the spirit of the invention is not limited to any particular embodiment, but may take many forms, defined only by the claims which follow.

I claim:

1. A detachable shroud for a firearm hammer, comprising:

a. a clip portion adapted to grip a spur of the hammer;

b. a frame-contacting portion adapted to rest against a frame of the firearm in use;

c. a body connecting the clip portion to the frame-contacting portion;

d. wherein the shroud is so configured that the clip portion releases its grip on the spur of the hammer when the hammer moves backward relative to the frame of the firearm.

2. The shroud of claim 1 wherein the clip portion, frame-contacting portion, and body are integrally formed of a single piece of material.

3. The shroud of claim 2 wherein the material is a polymer.

4. The shroud of claim 3 wherein the material is nylon.

5. The shroud of claim 3 wherein the material is ABS.

6. The shroud of claim 3 wherein the material is an acrylic-PVC alloy.

7. The shroud of claim 3 wherein the shroud is produced by vacuum thermoforming.

8. The shroud of claim 2 wherein the material is a metal.

* * * * *